US005296897A

United States Patent [19]

Amemiya et al.

[11] Patent Number: 5,296,897

[45] Date of Patent: Mar. 22, 1994

[54] IMAGE FORMING APPARATUS FOR FORMING MULTI-IMAGE ON TRANSFER SHEET WITH PLURAL COLOR TONERS

[75] Inventors: Koji Amemiya, Tokyo; Yuji Sakemi, Inagi; Masami Izumizaki, Yokohama, all of Japan

[73] Assignee: Canon Kabushiki Kaisha, Tokyo, Japan

[21] Appl. No.: 25,338

[22] Filed: Mar. 3, 1993

[30] Foreign Application Priority Data

Mar. 4, 1992 [JP] Japan ..... 4-082711

[51] Int. Cl.[5] ..... G03G 15/00

[52] U.S. Cl. ..... 355/208; 355/271; 355/327

[58] Field of Search ..... 355/208, 203, 204, 327, 355/271, 273, 274, 296

[56] References Cited

U.S. PATENT DOCUMENTS 4,277,162 7/1981 Kasahara et al. .
4,883,019 11/1989 Menjo et al. ..... 118/691
4,887,101 12/1989 Hirose et al. ..... 355/327 X
4,999,673 3/1991 Bares ..... 355/208
5,172,172 12/1992 Amemiya et al. ..... 355/271
5,175,585 12/1992 Matsubayashi et al. ..... 355/208
5,187,536 2/1993 Hasegawa et al. ..... 355/327

FOREIGN PATENT DOCUMENTS 2244350 11/1991 United Kingdom ..... 355/327 A

*Primary Examiner*—R. L. Moses
*Attorney, Agent, or Firm*—Fitzpatrick, Cella, Harper & Scinto

[57] ABSTRACT

The present invention aims to improve the image forming efficiency by selecting positions where image adjusting toner images are formed to non-image areas of convey means by changing the supply timing of a transfer sheet onto the convey means, in an image forming apparatus wherein a plurality of electrophotographic photosensitive members are arranged side by side and color toner images formed on the photosensitive members are successively transferred onto a transfer sheet supplied at transfer positions for the photosensitive members thereby to form a color image on the transfer sheet.

7 Claims, 3 Drawing Sheets

IMAGE FORMING APPARATUS FOR FORMING MULTI-IMAGE ON TRANSFER SHEET WITH PLURAL COLOR TONERS

BACKGROUND OF THE INVENTION

1. Field of the Invention

The present invention relates to an image forming apparatus, and more particularly, it relates to a color copying apparatus having a plurality of image bearing members and an image density control technique.

2. Related Background Art

In the past, various image forming apparatuses, and more specifically, multi-color electrophotographic copying apparatuses capable of forming a full-color image have been proposed. A typical example of such apparatuses is shown in FIG. 4 showing an elevational sectional view of a copying machine.

Within a frame C of the copying machine, four image forming portions Pa, Pb, Pc, Pd are disposed at substantially the same height, which image forming portions Pa–Pd are provided with electrophotographic photosensitive drums (image bearing members) 1*a*, 1*b*, 1*c*, 1*d* each comprising an endless electrophotographic photosensitive layer. The photosensitive drums 1*a*–1*d* which are arranged side by side are rotatably supported by the frame C of the machine in such a manner that the respective axes of the drums are parallel with each other. The drums are rotated in directions shown by the arrows by means of an appropriate drive means (not shown).

An exposure means L for illuminating color decomposed information light beams on the photosensitive drums 1*a*–1*d* is disposed above the photosensitive drums so that the light from a light source device (not shown) illuminates the photosensitive drums 1*a*–1*d* via polygon mirrors 17, thereby forming electrostatic latent images on the drums.

Further, around the photosensitive drums 1*a*–1*d*, there are disposed, in order, primary chargers 2*a*, 2*b*, 2*c*, 2*d* for uniformly charging surfaces of the photosensitive drums 1*a*–1*d*, potential sensors 22*a*, 22*b*, 22*c*, 22*d* for measuring surface potentials of the photosensitive drums 1*a*–1*d*, developing devices 3*a*, 3*b*, 3*c*, 3*d* for containing color toners (yellow toner, magenta toner, cyan toner and black toner) and adapted to develop the electrostatic latent images on the photosensitive drums 1*a*–1*d* to obtain color toner images, transfer charger devices 4*a*, 4*b*, 4*c*, 4*d* for transferring the color toner images onto a transfer sheet S (described later), cleaning devices 5*a*, 5*b*, 5*c*, 5*d* for removing the residual toners remaining on the photosensitive drums 1*a*–1*d*, and charge removing exposure devices 21*a*, 21*b*, 21*c*, 21*d* for removing charges from the photosensitive drums 1*a*–1*d*, respectively. These photosensitive drums 1*a*–1*d* are equidistantly spaced apart from each other along a feeding direction of the transfer sheet S and are designed to provide a yellow color toner image, a magenta color toner image, a cyan color toner image and a black color toner image, in that order, from an upstream side (right side in FIG. 4) of the copying machine frame C. Incidentally, the transfer charger devices 4*a*–4*d* have transfer push members 41*a*, 41*b*, 41*c*, 41*d*, respectively, which are urged against a convey belt 8 (described later).

On the other hand, below the photosensitive drums 1*a*–1*d*, there is disposed the convey belt 8 which is wound around rollers 10, 11 and is rotatingly driven by the rollers. The convey belt 8 is made from dielectric resin film such as a polyethylene terephthalate resin film sheet (PET sheet), polyvinylidene fluoride resin film sheet or a polyurethane resin film sheet, and is formed as an endless belt by connecting the respective ends of the film to each other, or as a seamless endless belt. Incidentally, in the case of a belt having a seam, a detection means may be provided for detecting the seam of the belt, so that the toner image is not transferred on the seam.

Further, a belt charge removing device 12 and a belt cleaning means 16 are arranged in a confronting relation to the convey belt 8, so that, after the any charge on the toner remaining on the convey belt 8 is removed by the belt charge removing device 12 to remove the electrostatic absorption force from the toner, the toner is removed by the belt cleaning means 16. Incidentally, the belt cleaning means 16 is constituted by a rotatable fur brush opposed to the convey belt. However, in place of the fur brush, a blade or non-woven cloth may be used, or the fur brush may be used together with such a blade or non-woven cloth. An elastic member 16*a* such as a brush serves to urge the belt 8 against the fur brush 16.

On the other hand, a cassette 60 containing a number of transfer sheets (cut sheets) S is mounted on the frame C of the machine at the upstream end (right side) thereof, and a pick-up roller 26 for picking up the transfer sheet S from the cassette is disposed above the cassette 60 at a downstream end thereof. A pair of register rollers 13 are disposed in the vicinity of the pick-up roller 26, which register rollers are rotatably supported by the frame C and are rotatingly driven by an appropriate drive means (not shown).

Further, a fixing device 7 is disposed within the frame C at the downstream end (left side) thereof, which fixing device has a fixing roller 71, a pressure roller 72, heat-resistive cleaning members 73, 74 for cleaning the rollers 71, 72, respectively, heaters 75, 76 for heating the rollers 71, 72, respectively, an oil applicator roller 77 for applying a mold releasing agent oil such as dimethyl silicone to the fixing roller 71, an oil reservoir 78 for supplying the mold releasing agent oil, and a fixing temperature controlling thermistor 79. The fixing device is designed to permanently fix the toner image to a transfer sheet S fed by the convey belt 8.

With the arrangement is as mentioned above, when a predetermined image forming signal is emitted, the photosensitive drums 1*a*–1*d* are rotated by the drive means (not shown), and the primary chargers 2*a*–2*d* start to uniformly charge the surfaces of the photosensitive drums 1*a*–1*d*. Further, the exposure device L exposes the photosensitive drums 1*a*–1*d* in correspondence with the respective colors to form the electrostatic latent images on the drums, and then, the developing devices 5*a*–5*d* develop the respective electrostatic latent images with the respective color toners, thereby forming the various color toner images.

On the other hand, the pick-up roller 26 is rotated in response to a predetermined signal, with the result that the transfer sheet S is fed from the cassette 60 to the interior of the frame C to be rested on the convey belt 8. Since the convey belt 8 is being rotated by the drive means (not shown), the transfer sheet S is electrostatically held on the belt and is conveyed toward the downstream side of the machine while contacting the photosensitive drums 1*a*–1*d* successively. While the transfer sheet S is in contact with the photosensitive drums 1a–1d, respectively, high voltages are applied to the transfer charger devices 6a–6d, respectively, with the result that the various color toner images on the photosensitive drums 1a–1d are transferred onto the transfer sheet S in superimposed fashion, thereby forming a full-color toner image on the transfer sheet S. Thereafter, the transfer sheet S is sent to the fixing device 7, where the full-color toner image is fixed to the transfer sheet S. Then, the transfer sheet S is discharged out of the machine. On the other hand, the toners remaining on the photosensitive drums 1a–1d are removed by the cleaning devices 7a–7d, respectively, with the result that the photosensitive drums 1a–1d can be used for the next image formation.

In a copying machine having the above-mentioned construction, image density control is effected in order to effect proper correspondence between the full-color toner image and an image on the original. Now, the image density control will be explained.

Density measuring sensors (not shown) are disposed in a confronting relation to the photosensitive drums 1a–1d, and a control means (not shown) for making the image forming condition best is incorporated within the frame C of the copying machine. In performing the density control for the toner images formed on the photosensitive drums, density measuring reference latent images are formed on the photosensitive drums 1a–1d by illuminating information light beams in response to a predetermined signal. The density measuring sensors serve to measure the density of the toner images which are obtained by visualizing the respective reference latent images with the toners, and the control means serves to control the toner density on the basis of the measured result from each density measuring sensor.

Incidentally, there are various control methods effected by the control means. Typical examples of such control methods are as follows:

(1) Method for changing a so-called "development contrast" by controlling the charging bias applied to each of the primary charges 2a–2d, an exposure light amount from the exposure device L or the developing bias applied to each of the developing devices 3a–3d;

(2) Method for altering or correcting the contents of a look-up table to ensure the density gradient in response to input video signals, in a digital copying machine; and (3) Method for replenishing an amount of toner corresponding to the amount consumed by the developing operation to each of the developing devices 3a–3d, in a two-component developer developing system.

Among these control methods, it is known that the methods (1) and (2) can maintain the image reproductivity more stably.

By the way, in the above-mentioned conventional copying machine, even when a number of transfer sheets S are sequentially supplied to form the image on each transfer sheet, it was necessary to always maintain the density of each toner image properly by effecting a image density control method such as the above method (1), (2) or (3). Further, in the method (3) relating to the two-component developer developing system, although the toner is charged by the frictional charge between the toner and carrier particles, if a large amount of toner is replenished at a time, it takes a long time to uniformly mix the toner with the carrier particles, with the result that the frictional charge cannot be effected uniformly, and, therefore, it is feared that the image cannot be formed properly. In order to avoid this, it is necessary to effect the image density control frequently. When the image density control is effected frequently, the reference toner images must frequently be formed on the photosensitive drums 1a–1d accordingly.

On the other hand, in the digital copying machine, digital data corresponding to the density of the original image is converted in a predetermined manner, and the converted data is used as a drive signal for the exposure device L. The amount of toner consumed is calculated on the basis of the total digital data, and the image density control is effected on the basis of the calculated result. In this case, although the reference toner images are not formed frequently, the reference toner images must be formed at a predetermined interval (normally, one reference toner image per 100 copies) in order to correct the error caused by totalling the digital data.

The reference toner images so formed are contacted to the convey belt 8 as the photosensitive drums 1a–1d are rotated, and are transferred onto the convey belt 8 by the electric action of the transfer charger devices 4a–4d and the urging forces of the urging members 41a–41d. However, the more the frequency of the formation of the reference toner image is increased, the more the convey belt 8 is smudged. Although the belt cleaning means 16 is provided for removing such contamination of the belt, in some cases regarding the material (for example, polycarbonate) of the convey belt 8, the contamination of the belt cannot be fully removed by only one cleaning operation. As a result, if a transfer sheet S rests on the smudged portion of the belt, then the back surface of the transfer sheet S is smudged with the toner, which is not desirable. To the contrary, if image formation is delayed until the whole belt is completely cleaned, since the convey belt is very long, it takes a long time to complete the image forming operation, thereby reducing the image forming efficiency.

SUMMARY OF THE INVENTION

An object of the present invention is to eliminate the above-mentioned conventional drawbacks, that is, to provide a cleaning apparatus which can sufficiently remove contamination on a convey belt.

Another object of the present invention is to improve image forming efficiency when a multi-image is formed by using a plurality of photosensitive bodies.

A further object of the present invention is to improve the quality of an image formed on a transfer sheet and the image forming efficiency.

In order to achieve the above objects, the present invention provides an image forming apparatus for forming a multi-image on a transfer sheet with plural color toners, comprising a plurality of electrophotographic photosensitive members each having an endless electrophotographic photosensitive layer; a light information illuminating means arranged in a confronting relation to the photosensitive members and adapted to illuminate light information; developing means for developing areas on the photosensitive members illuminated by the light information illuminating means with color toners, and transfer means for electrostatically transferring toner images developed by the developing means onto a transfer sheet; detecting developed image measuring means associated with the respective photosensitive members and adapted to measure conditions of detecting toner images formed in image forming areas of the photosensitive members by the developing means in order to detect image formation conditions of the photosensitive members; an image forming condition adjusting means for adjusting image forming conditions on the photosensitive members on the basis of the measured results from the detecting developed image measuring means; a transfer sheet conveying means in contact with the photosensitive members at transfer positions for the respective photosensitive members and moved along an endless path to convey the transfer sheet to the transfer positions for the respective photosensitive members and having a length longer than the sum of an image area of each photosensitive member and a non-image area between the adjacent image areas by integral times, and adapted to carry and convey a plurality of transfer sheets simultaneously; a transfer sheet supplying means capable of supplying the transfer sheets to the transfer sheet conveying means successively; and a transfer sheet conveying means cleaning means disposed in a confronting relation to the transfer sheet conveying means and adapted to clean a surface of the transfer sheet conveying means which can face the photosensitive members. Toner images to be measured by the developed image measuring means for detecting the image formation conditions are formed on the photosensitive members, in the image areas of the photosensitive members and in correspondence to the non-image areas of the transfer sheet conveying means.

Further, the present invention includes a cleaning result detecting means for detecting the condition of the transfer sheet conveying means cleaned by the cleaning means when the toner images to be measured by the developed image measuring means for detecting the image formation conditions are not formed on non-image areas of the transfer sheet, so that the transfer sheets are supplied onto the cleaned areas on the transfer sheet conveying means ascertained by the cleaning result detecting means.

With the arrangement as mentioned above, in an image forming apparatus wherein a plurality of electrophotographic photosensitive members are arranged side by side and color toner images formed on the photosensitive members are successively transferred onto a transfer sheet conveyed at transfer positions for the photosensitive members, thereby forming a full-color image on the transfer sheet, the image forming efficiency can be improved.

DETAILED DESCRIPTION OF THE PREFERRED EMBODIMENTS

Figure 4:
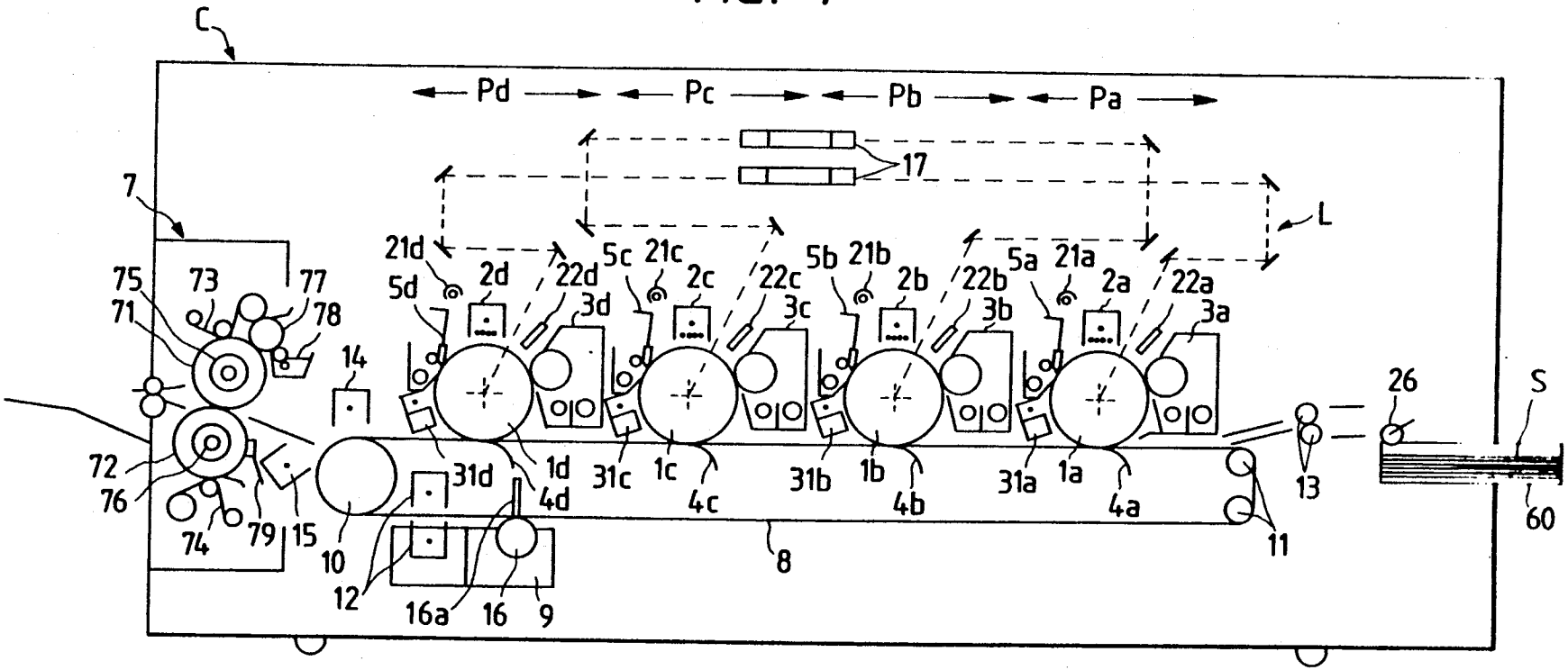
FIG. 4 is an elevational sectional view showing a typical copying machine.

The present invention will now be explained in connection with embodiments thereof. Incidentally, the same structural elements as described in the conventional ones shown in FIG. 4 are designated by the same reference numerals, and the explanation thereof will be omitted.

Figure 1:
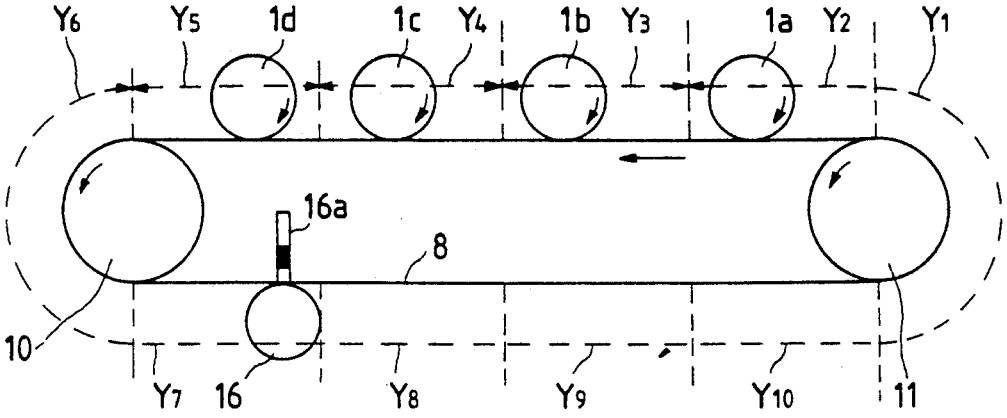
FIG. 1, is a schematic sectional view of a main portion of an image forming apparatus according to an embodiment of the present invention.

FIG. 1 shows a construction of a main portion of a copying machine to which the present invention is applied. The material of the convey belt 8 may be rubber, resin or polycarbonate. The convey belt 8 has transfer sheet resting areas on which transfer sheets S are rested, and transfer sheet non-resting areas. A circumferential length of the convey belt 8 is greater than the sum of the transfer sheet resting area which is an image forming area and the transfer sheet non-resting area between the adjacent transfer sheet resting areas by an integral number of times. Incidentally, a length of the transfer sheet resting area is equal to a width of a transfer sheet S of A4 size, for example. Reference to images are formed in image forming areas of the photosensitive members 1*a*–1*d* in correspondence to the transfer sheet non-resting areas of the convey belt.

Incidentally, since the cleaning means 16 tends to sweep the toner on the convey belt 8 toward a downstream side, zones on which the transfer sheets S are not rested are portions which are disposed between the transfer sheets S and on which the transfer sheets S are not rested (formed in an area from $Y_1$ to $Y_{10}$ in FIG. 1). Regarding the cleaning of the convey belt 8, when it was previously measured how many cleaning operations are required until the back surface of the transfer sheet S is not smudged by the toner, after such number of cleaning operations have been completed, the cleaning operation may be stopped.

Incidentally, in the illustrated embodiment, each reference toner image has a size smaller than a size of the minimum transfer sheet and smaller than the area between the adjacent transfer sheets. Further, although the length of the convey belt is longer than the sum of the image forming area and the image non-forming area by an integral number of times, each image forming area is defined or determined by the minimum size transfer sheet to be used.

Further, regarding a concrete method for forming the reference toner image on the image non-forming area, the reference toner image is formed in the image forming area on the photosensitive member at a predetermined timing and the supply timing of the transfer sheet is delayed, thereby transferring the toner image on the image non-forming area on the belt. Alternatively, the reference toner image may be formed in an area before or after the image forming area on the photosensitive drum, thereby transferring the reference toner image on the transfer sheet supplied at the normal timing to form the toner image in the image non-forming area on the belt.

As mentioned above, in the image forming apparatus wherein a plurality of photosensitive members are arranged side by side, since the length of the convey belt is longer than a length required to obtain one complete image, the image forming efficiency can be improved As an alternative to forming the reference toner image on the image non-forming area of the convey belt, the reference toner image may be formed in the predetermined image forming area on the photosensitive member, and the su of the transfer sheet onto the convey belt may be delayed until the predetermined number of cleaning operations by the cleaning means 16 are finished. That is to say, the number of cleaning operations may be previously set, and, during the cleaning operations, the supply of the transfer sheet onto the convey belt is stopped. Thereafter, the supply of the transfer sheet is started.

In this alternative method, the image non-forming area of the belt is defined by a zone of the belt passing through the transfer positions for the photosensitive members during the predetermined number of cleaning operations.

Next, another embodiment of the present invention will be explained with reference to FIG. 2.

Figure 2:
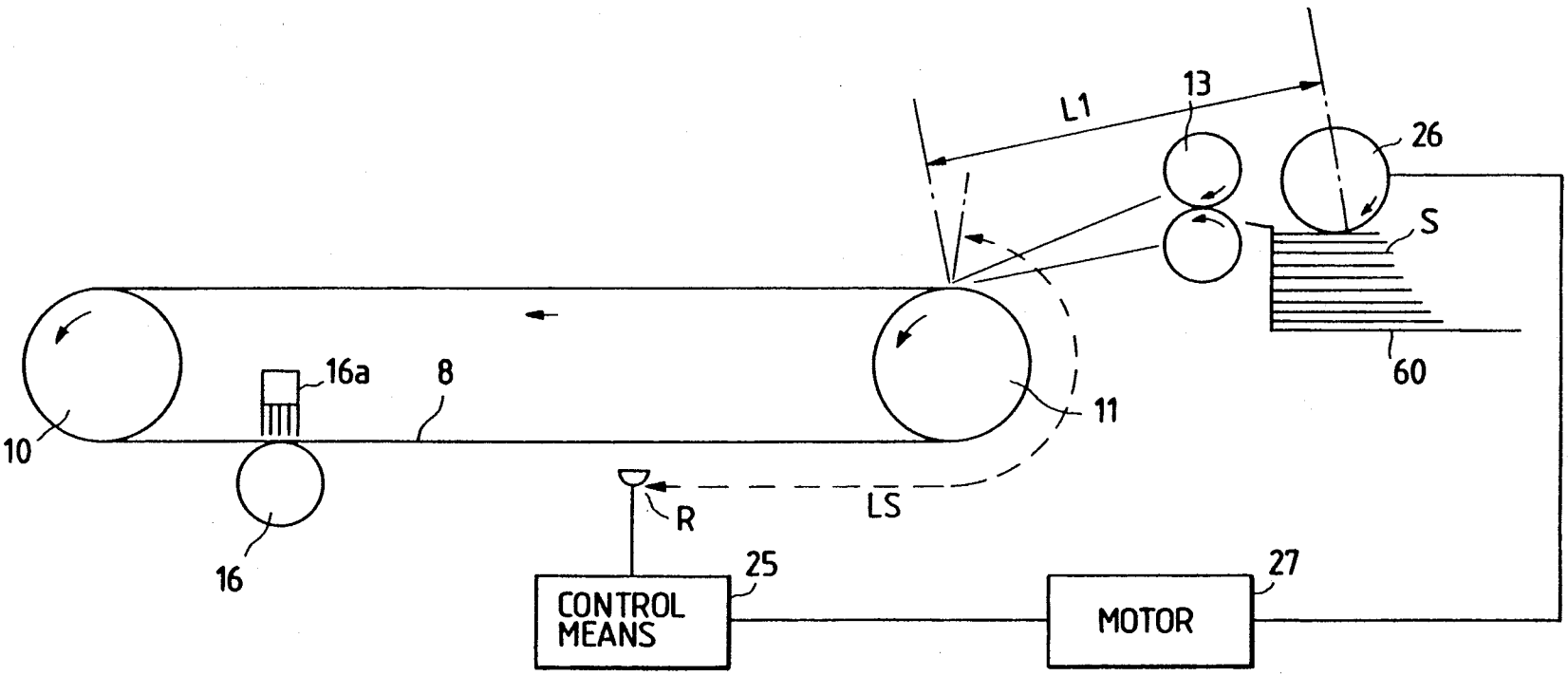
FIG. 2 is a schematic sectional view of a main portion of an image forming apparatus according to another embodiment of the present invention.

A surface sensor R shown in FIG. 2 serves to detect contamination (such as toner adhesion) on the surface of the convey belt 8, and is disposed in a confronting relation to the convey belt 8, particularly at a position where there is no time loss to position the transfer sheet S on the convey belt 8 after a detection signal is emitted (a position spaced apart from a resting start position by a distance of Ls). A control means 25 is connected to the surface sensor R, which control means serves to judge whether the transfer sheet S can be positioned on the convey belt 8 on the basis of the detection signal from the surface sensor R. When the control means 25 judges that the transfer sheet S can be positioned on any area of the convey belt 8, a drive means (motor) 27 for the pick-up roller 26 is activated to drive the pick-up roller, thereby supplying the transfer sheet S from the cassette 60 to the interior of the frame C of the copying machine. The supplied transfer sheet S is further fed by the register rollers 13 in registration with the rotations of the photosensitive drums 1*a*–1*d*.

Incidentally, the position where the surface sensor R is arranged is determined by the following equation:

$$Ls = Vp \times (Ll/Vf + a);$$

where Ls is a distance between a position where the surface sensor R is arranged and a position where the transfer sheet S is rested on the convey belt 8 (See FIG. 2) Vp a process speed, Ll is a distance between a position of the pick-up roller 26 and the position where the transfer sheet S is rested on the convey belt 8, Vf is an average speed of the transfer sheet S supplied from the cassette 60, and a is a time required to release a control mode for inhibiting the resting of the transfer sheet S and to emit the command for positioning the transfer sheet.

In this embodiment, for example, if the control means judges that the transfer sheet cannot be positioned on only the sections $Y_2$ and $Y_4$ (among $Y_1$–$Y_{10}$) of the belt 8 in FIG. 1, the transfer sheets are positioned on the other sections of the belt, thereby improving the efficiency of the image output.

Figure 3:
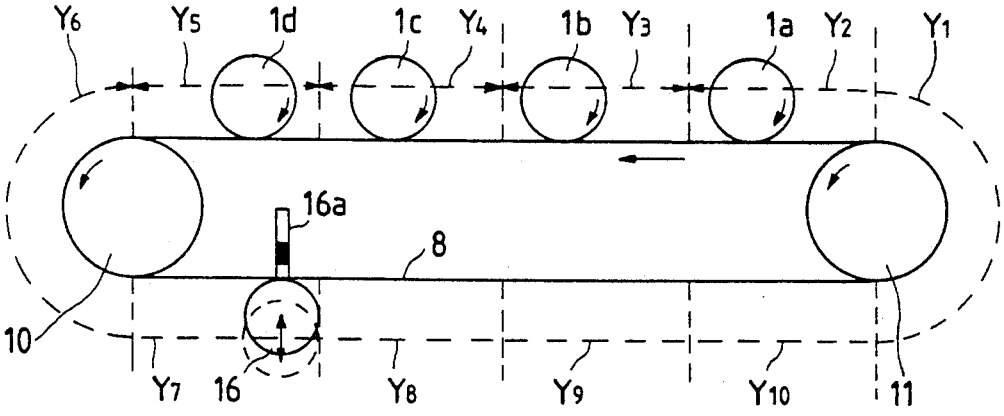
FIG. 3 is a schematic sectional view of a main portion of an image forming apparatus according to a further embodiment of the present invention.

A further embodiment of the present invention will be explained with reference to FIG. 3.

In this embodiment, when polycarbonate is used as the material of the convey belt 8, the toner on the convey belt 8 often is not removed completely by the single cleaning operation by means of the cleaning means 16. In this case, when the transfer sheet S is positioned on an area where the toner remains, the back surface of the transfer sheet S is smudged, which is not desirable.

Generally, since the cleaning means 16 tends to sweep the toner on the convey belt 8 toward a downstream side, it is preferable that a first zone between the adjacent transfer sheets and a second zone contiguous to the first zone and having a length corresponding to the width of the transfer sheet are selected as an area where the transfer sheet S should not be positioned.

By the way, in this embodiment, the cleaning means 16 acts on only smudged regions of the convey belt 8 where the toner is adhered. With this arrangement, the toner adhered to the convey belt 8 can be removed, and the wear of the cleaning means 16 can be minimized since the cleaning means is operated only when needed.

Incidentally, it is preferable that the cleaning means 16 acts on the convey belt from a leading end of the first zone between the adjacent transfer sheets to a trailing end of the second zone contiguous to the first zone and having the length corresponding to the width of the transfer sheet. Further, also in this embodiment, similar to the second embodiment, by providing a surface sensor R and a control means as mentioned above, the transfer sheets S are positioned on the convey belt 8 only when the belt is cleaned.

As mentioned above, according to the first embodiment, since the convey belt is divided into the transfer sheet resting sections and the transfer sheet non-resting sections and the density measuring reference toner images are not transferred onto the transfer sheet resting sections of the convey belt, the toner is not adhered to the transfer sheet resting sections of the convey belt, and, therefore, when the transfer sheets are rested on the transfer sheet resting sections, the back surfaces of the transfer sheets are not smudged by the toner.

Further, according to the second embodiment, since the transfer sheet is rested only after the surface of the convey belt is cleaned, the back surface of the transfer sheet rested on the belt is not smudged by the toner.

Furthermore, according to the third embodiment, since the cleaning means for cleaning the convey belt acts on only the areas to which the toner is adhered, even when the cleaning means is contacted with the convey belt, the wear of the cleaning means can be minimized.

Incidentally, the present invention is effective particularly when the same images are formed successively. Further, the first embodiment gives an advantage that the reference toner image can be formed even between the outputs of the successive images.

What is claimed is:

1. An image forming apparatus for forming a multi-image on a transfer sheet with plural color toners, comprising:

a plurality of electrophotographic photosensitive members each having an endless electrophotographic photosensitive layer;

light information illuminating means arranged in a confronting relation to said photosensitive members and adapted to illuminate light information;

developing means for developing respective areas on said photosensitive members illuminated by said light information illuminating means with color toners;

transfer means for electrostatically transferring respective toner images developed by said developing means onto a transfer sheet;

detecting developed image measuring means associated with the respective photosensitive members and adapted to measure conditions of detecting toner images formed in respective image forming areas of said photosensitive members by said developing means in order to detect image formation conditions of said photosensitive members;

image forming condition adjusting means for adjusting image forming conditions on said photosensitive members on the basis of measured results from said detecting developed image measuring means;

transfer sheet conveying means contacted with said photosensitive members at respective transfer positions for the respective photosensitive members and moved along an endless path to convey a transfer sheet to said respective transfer positions for the respective photosensitive members and having a length longer than the sum of an image area of said photosensitive member and a non-image area between the adjacent image areas by an integral number of times, and adapted to carry and convey a plurality of transfer sheets simultaneously;

transfer sheet supplying means capable of supplying a plurality of transfer sheets to said transfer sheet conveying means successively; and transfer sheet conveying means cleaning means disposed in a confronting relation to said transfer sheet conveying means and adapted to clean a surface of said transfer sheet conveying means which can face said photosensitive members;

wherein toner images to be measured by said developed image measuring means for detecting the image formation conditions are formed on said photosensitive members, in the image areas of said photosensitive members in correspondence to the non-image areas of said transfer sheet conveying means.

2. An image forming apparatus according to claim 1, wherein an image formation timing on a photosensitive member is changed so that a toner image to be measured by said developed image measuring means is formed at a position corresponding to a non-image area of said transfer sheet conveying means.

3. An image forming apparatus according to claim 1, wherein a timing of the supply of a transfer sheet onto said transfer sheet conveying means is changed so that a toner image to be measured by said developed image measuring means is formed at a position corresponding to a non-image area of said transfer sheet conveying means.

4. An image forming apparatus according to claim 1, wherein a toner image to be measured by said developed image measuring means is formed in an image area on a photosensitive member, and a transfer sheet conveying means where said toner image is to be transferred, thereby using said zone as the non-image area of said transfer sheet conveying means.

5. An image forming apparatus according to claim 1, wherein a detection toner image formed by said developing means in order to detect an image formation condition of a photosensitive member is formed between a plurality of successive image forming steps.

6. An image forming apparatus for forming a multi-image on a transfer sheet with plural color toners, comprising:

a plurality of electrophotographic photosensitive members each having an endless electrophotographic photosensitive layer;

light information illuminating means arranged in a confronting relation to said photosensitive members and adapted to illuminate light information;

developing means for developing respective areas on said photosensitive members illuminated by said light information illuminating means with color toners;

transfer means for electrostatically transferring respective toner images developed by said developing means onto a transfer sheet;

detecting developed image measuring means associated with the respective photosensitive members and adapted to measure conditions of detecting toner images formed in respective image forming areas of said photosensitive members by said developing means in order to detect image formation conditions of said photosensitive members;

image forming condition adjusting means for adjusting image forming conditions on said photosensitive members on the basis of measured results from said detecting developed image measuring means;

transfer sheet conveying means contacted with said photosensitive members at respective transfer positions for the respective photosensitive members and moved along an endless path to convey a transfer sheet to said respective transfer positions for the respective photosensitive members and having a length longer than the sum of an image area of each photosensitive member and a non-image area between the adjacent image areas by an integral number of times, and adapted to carry and convey a plurality of transfer sheets simultaneously;

transfer sheet supplying means capable of supplying a plurality of transfer sheets to said transfer sheet conveying means successively;

transfer sheet conveying means cleaning means disposed in a confronting relation to said transfer sheet conveying means and adapted to clean a surface of said transfer sheet conveying means which can face said photosensitive members; and cleaned result detecting means for detecting a condition of cleaning by said cleaning means;

wherein toner images to be measured to detect the image formation conditions are formed in respective image areas of said photosensitive members, and a transfer sheet is supplied on a zone of said transfer sheet conveying means, of which a condition of cleaning is detected by said cleaned result detecting means.

7. An image forming apparatus according to claim 6, wherein a detecting toner image is formed in a region smaller than a smallest size of a transfer sheet, and said cleaning means acts on only a region where the detecting toner image is formed.

* * * * *

UNITED STATES PATENT AND TRADEMARK OFFICE

CERTIFICATE OF CORRECTION

PATENT NO. 5,296,897

DATED March 22, 1994

INVENTOR(S) KOJI AMEMIYA, ET AL.

It is certified that error appears in the above-indentified patent and that said Letters Patent is hereby corrected as shown below:

Column 2

Line 6, change "other," to --other--.
Line 13, delete "the" (second occurrence).

Column 3

Line 59, change "a" to --an--.

UNITED STATES PATENT AND TRADEMARK OFFICE

CERTIFICATE OF CORRECTION

PATENT NO. 5,296,897

DATED March 22, 1994

INVENTOR(S) KOJI AMEMIYA, ET AL.

It is certified that error appears in the above-indentified patent and that said Letters Patent is hereby corrected as shown below:

Column 6

Line 56, change "improved" to --improved.--
Line 61, change "su" to --supply--.

Column 7

Line 32, change "where" to --where:--.
Line 35, change "2) Vp" to --2), Vp is--.

Signed and Sealed this

Twenty-seventh Day of September, 1994

*Attest:*

*Attesting Officer*

BRUCE LEHMAN

*Commissioner of Patents and Trademarks*